US011408651B2

(12) United States Patent
Berg et al.

(10) Patent No.: US 11,408,651 B2
(45) Date of Patent: Aug. 9, 2022

(54) HEATING, VENTILATION, AIR-CONDITIONING, AND REFRIGERATION SYSTEM WITH VARIABLE SPEED COMPRESSOR

(71) Applicant: Lennox Industries Inc., Richardson, TX (US)

(72) Inventors: Eric Berg, The Colony, TX (US); Austin Clay Styer, Plano, TX (US); Carl T. Crawford, Hickory Creek, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 17/184,065

(22) Filed: Feb. 24, 2021

(65) Prior Publication Data

US 2021/0180839 A1 Jun. 17, 2021

Related U.S. Application Data

(63) Continuation of application No. 15/830,919, filed on Dec. 4, 2017, now Pat. No. 10,955,175.

(51) Int. Cl.
*F25B 49/02* (2006.01)
*F25B 29/00* (2006.01)
(Continued)

(52) U.S. Cl.
CPC ..... *F25B 29/003* (2013.01); *F25B 30/02* (2013.01); *F25B 49/02* (2013.01); *F25B 49/022* (2013.01); *F25B 41/39* (2021.01); *F25B 2300/00* (2013.01); *F25B 2313/029* (2013.01); *F25B 2400/0403* (2013.01); *F25B 2500/02* (2013.01); *F25B 2600/0253* (2013.01); *F25B 2600/2501* (2013.01); *F25B 2700/19* (2013.01); *F25B 2700/21* (2013.01)

(58) Field of Classification Search
CPC .. F25B 6/00; F25B 6/04; F25B 29/003; F25B 30/02; F25B 41/39; F25B 49/02; F25B 49/022; F25B 49/025; F25B 2300/00; F25B 2313/029; F25B 2400/0403; F25B 2500/02; F25B 2600/2501; F25B 2600/2503; F25B 2600/2507; F25B 2700/19; F25B 2700/21
See application file for complete search history.

(56) References Cited

U.S. PATENT DOCUMENTS 7,559,207 B2 7/2009 Knight et al.
9,140,472 B2 * 9/2015 Shin ..... F25D 17/065
(Continued)

*Primary Examiner* — Jonathan Bradford
(74) *Attorney, Agent, or Firm* — Baker Botts L.L.P.

(57) ABSTRACT

An apparatus includes a high side heat exchanger, a second heat exchanger, a load, a variable speed compressor, and a three-way valve. The high side heat exchanger removes heat from a refrigerant. The second heat exchanger removes heat from the refrigerant. The load uses the refrigerant to remove heat from a space proximate the load. The variable speed compressor compresses the refrigerant from the load and directs the compressed refrigerant to the high side heat exchanger. The three-way valve, when operating in a first mode, directs the refrigerant from the high side heat exchanger to the load and when operating in a second mode, directs the refrigerant from the high side heat exchanger to the second heat exchanger.

17 Claims, 3 Drawing Sheets

(51) Int. Cl.
*F25B 30/02* (2006.01)
*F25B 41/39* (2021.01)

(56) References Cited

U.S. PATENT DOCUMENTS

2012/0318013 A1 12/2012 Hozumi et al.
2015/0298525 A1* 10/2015 Miyakoshi ..... F25B 6/04
62/160
2016/0153697 A1 6/2016 Hamamoto et al.

* cited by examiner

HEATING, VENTILATION, AIR-CONDITIONING, AND REFRIGERATION SYSTEM WITH VARIABLE SPEED COMPRESSOR

CROSS-REFERENCE TO RELATED APPLICATIONS

This application is a continuation of U.S. patent application Ser. No. 15/830,919 filed Dec. 4, 2017, by Eric Berg et al., and entitled "HEATING, VENTILATION, AIR-CONDITIONING, AND REFRIGERATION SYSTEM," which is incorporated herein by reference.

TECHNICAL FIELD

This disclosure relates generally to a cooling system, such as heating, ventilation, air-conditioning, and refrigeration (HVACR) system.

BACKGROUND

HVACR systems are used to cool or heat spaces, such as residential dwellings, commercial buildings, and/or refrigeration units. These systems cycle a refrigerant (also referred to as charge) that is used to cool or heat the spaces.

SUMMARY OF THE DISCLOSURE

This disclosure contemplates an unconventional heating or cooling system that includes a second heat exchanger that can be used to effectively expand the volume of the high pressure side (e.g., a condenser, heat pump, high side heat exchanger) of the system. By varying the volume of the high pressure side, the system can efficiently manage the high side pressure in the system. For example, when the variable speed compressor is operating at a low speed, the refrigerant can be directed away from the second heat exchanger to increase the refrigerant pressure in the system. When the variable speed compressor is operating at a high speed, the refrigerant can be directed to the second heat exchanger to decrease the refrigerant pressure in the system. Certain embodiments will be described below.

According to an embodiment, an apparatus includes a high side heat exchanger, a second heat exchanger, a load, a variable speed compressor, and a three-way valve. The high side heat exchanger removes heat from a refrigerant. The second heat exchanger removes heat from the refrigerant. The load uses the refrigerant to remove heat from a space proximate the load. The variable speed compressor compresses the refrigerant from the load and directs the compressed refrigerant to the high side heat exchanger. The three-way valve, when operating in a first mode, directs the refrigerant from the high side heat exchanger to the load and when operating in a second mode, directs the refrigerant from the high side heat exchanger to the second heat exchanger.

According to another embodiment, a method includes removing heat from a refrigerant using a high side heat exchanger and, when operating in a first mode, directing the refrigerant from the high side heat exchanger to a load. The method also includes, when operating in a second mode, directing the refrigerant from the high side heat exchanger to a second heat exchanger, removing heat from the refrigerant using the second heat exchanger, and directing the refrigerant from the second heat exchanger to the load. The method further includes using the refrigerant to remove heat from a space proximate the load, compressing the refrigerant from the load using a variable speed compressor, and directing the compressed refrigerant to the high side heat exchanger.

According to yet another embodiment, a system includes a high side heat exchanger, a second heat exchanger, a load, a variable speed compressor, a three-way valve, and a controller. The high side heat exchanger removes heat from a refrigerant. The second heat exchanger removes heat from the refrigerant. The load uses the refrigerant to remove heat from a space proximate the load. The variable speed compressor compresses the refrigerant from the load and directs the compressed refrigerant to the high side heat exchanger. The three-way valve, when operating in a first mode, directs the refrigerant from the high side heat exchanger to the load, and when operating in a second mode, directs the refrigerant from the high side heat exchanger to the second heat exchanger. The controller switches the operation of the three-way valve between the first mode and the second mode.

Certain embodiments provide one or more technical advantages. For example, an embodiment effectively expands the volume of the high pressure side when a variable speed compressor is operating at a high speed by directing refrigerant to an additional heat exchanger. As another example, an embodiment effectively lowers the volume of the high pressure side when a variable speed compressor is operating at a low speed by directing refrigerant away from an additional heat exchanger. As yet another example, an embodiment improves the efficiency of a cooling system when a variable speed compressor switches from operating at a low speed to a high speed. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
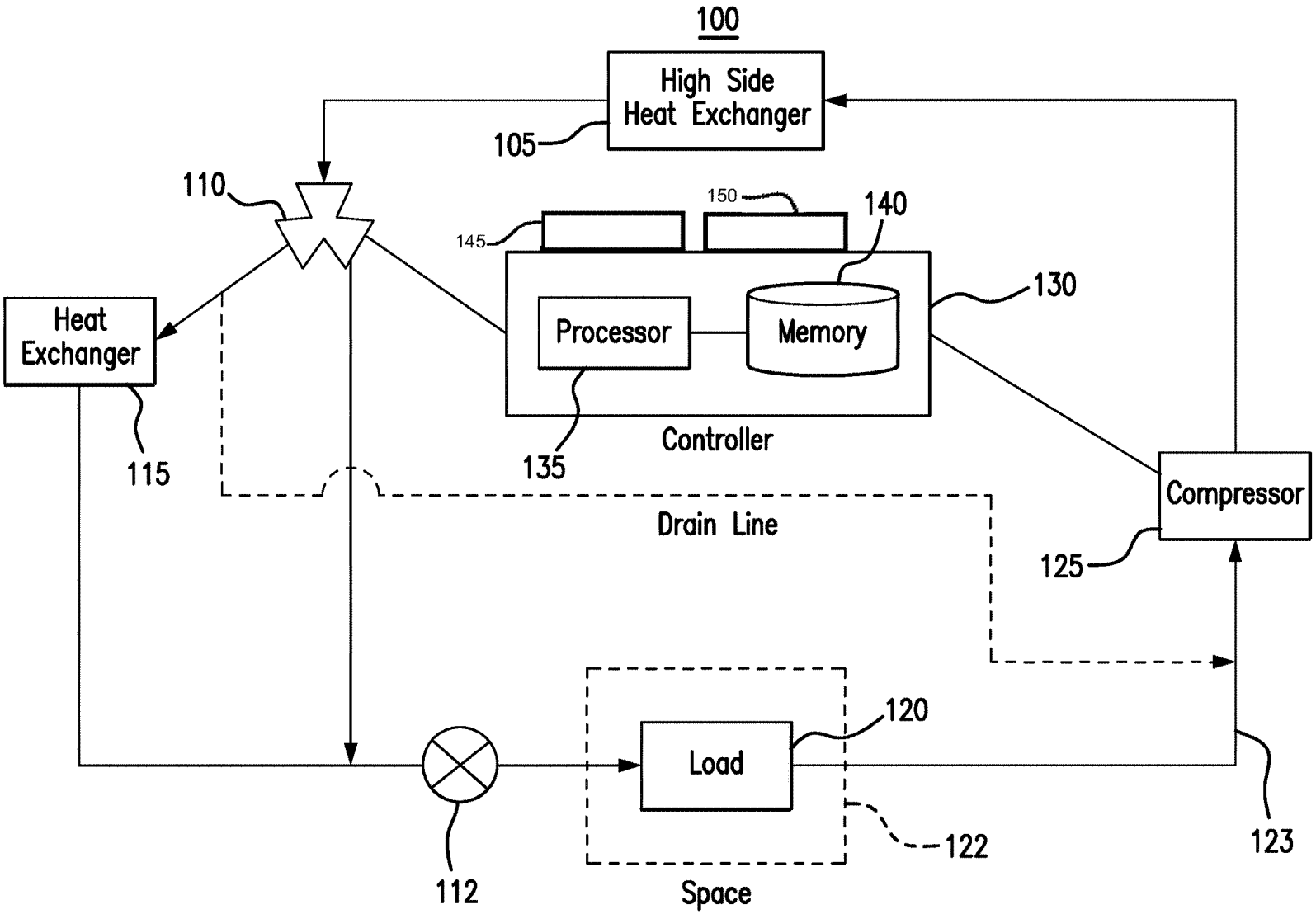
FIG. 1 illustrates portions of an example heating or cooling system.
Figure 2:
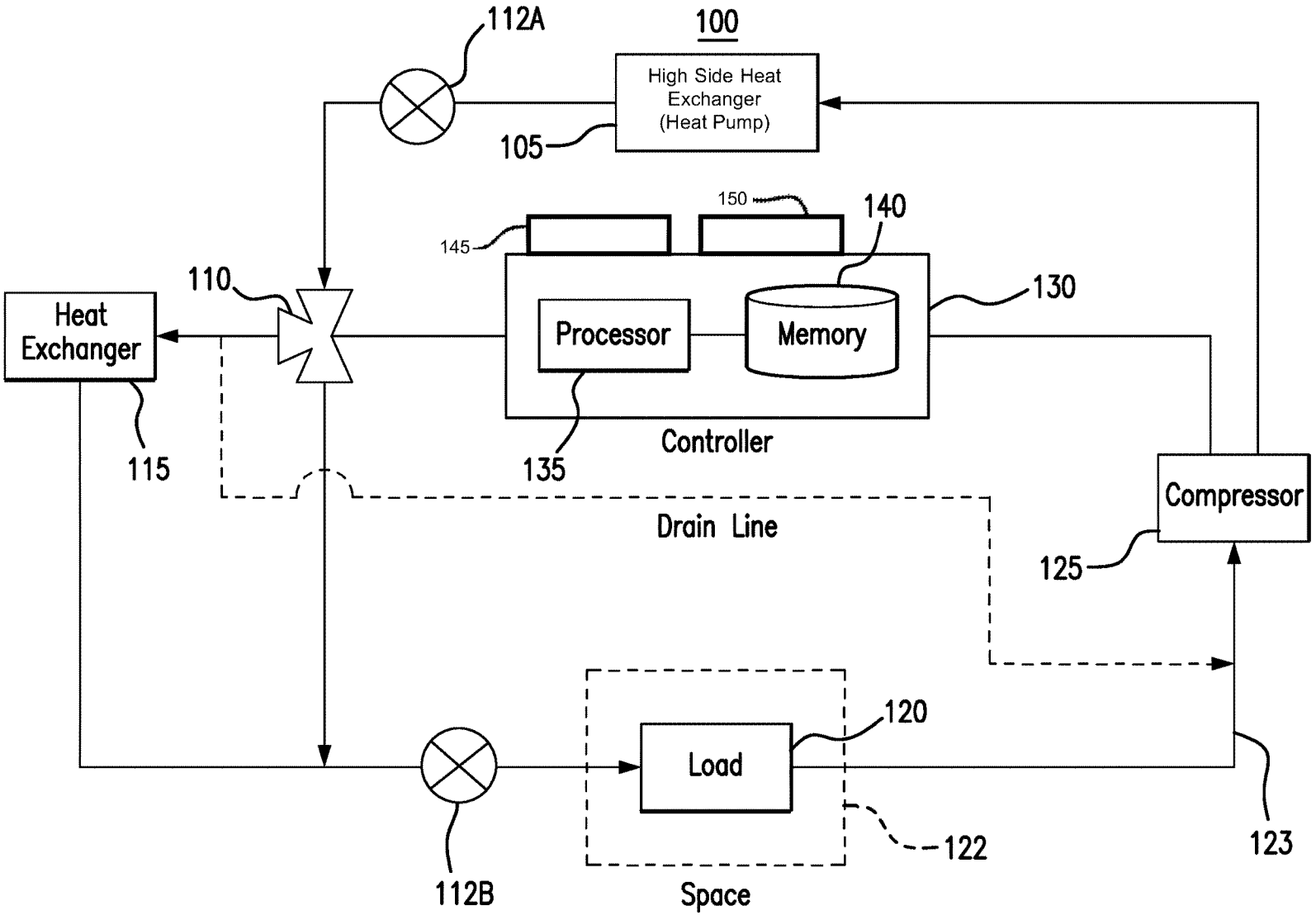
FIG. 2 illustrates portions of an example heating or cooling system.
Figure 3:
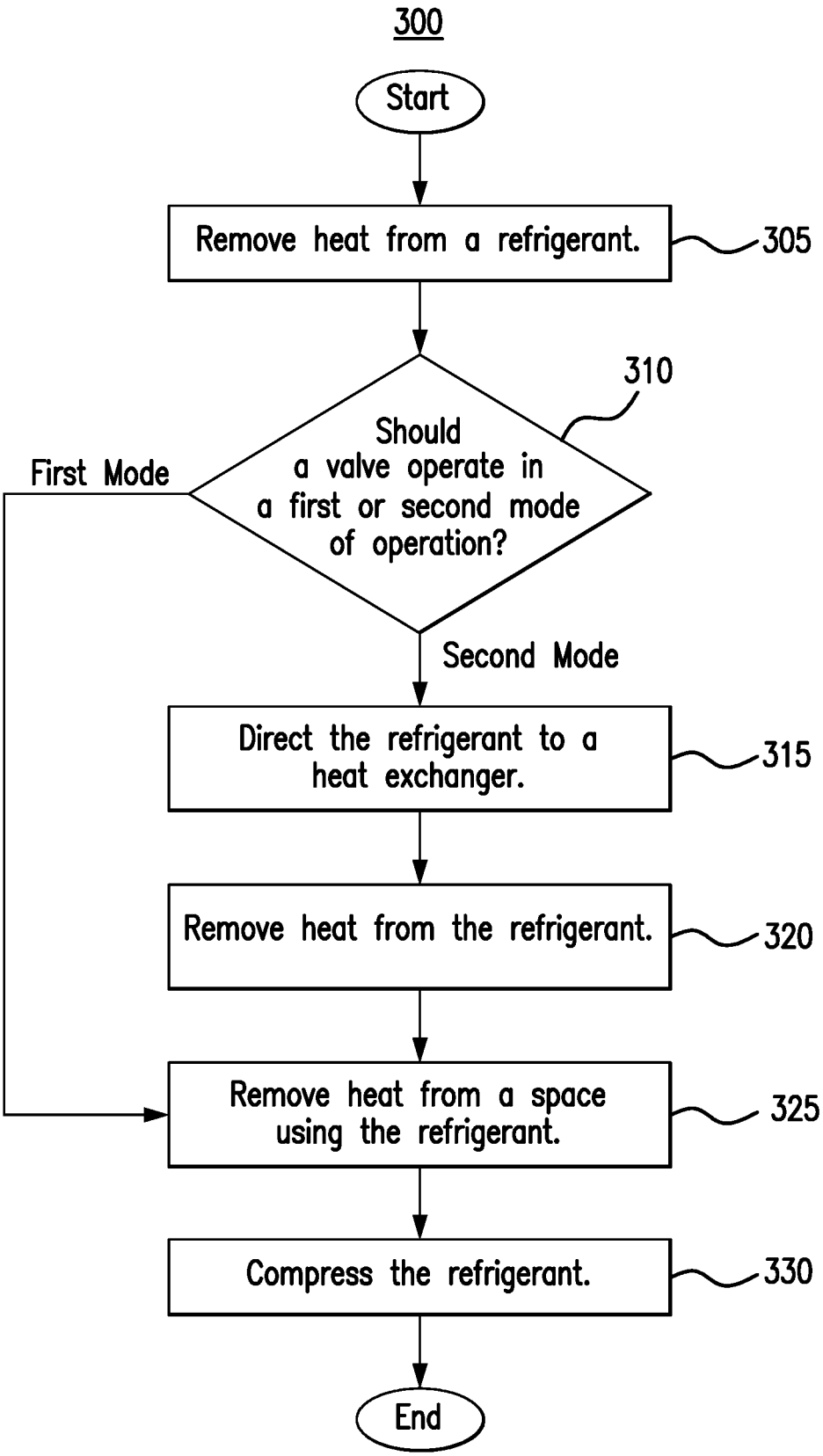
FIG. 3 is a flowchart illustrating a method for operating the systems of FIGS. 1 and 2.

Embodiments of the present disclosure and its advantages are best understood by referring to FIGS. 1 through 3 of the drawings, like numerals being used for like and corresponding parts of the various drawings.

Heating, ventilation, air-conditioning, and refrigeration (HVACR) systems are used to cool and/or heat spaces such as residential dwellings, commercial buildings and/or refrigeration units. These systems cycle a refrigerant (also referred to as charge) that is used to cool and/or heat the spaces. As the refrigerant is used, it absorbs heat from a space to cool the space. That heat is then removed from the refrigerant, and the refrigerant is cycled back to the space to absorb more heat from the space. Heat may also be added to the refrigerant so that the refrigerant may transfer the heat to the space to heat the space. This disclosure will largely discuss the system being used in cooling mode to cool a space, but it is contemplated that the system may also operate in a heating mode to heat the space.

Cooling systems typically include a component called a compressor that compresses the refrigerant after it has absorbed heat from the space. By compressing the refrigerant, the heat in the refrigerant becomes more concentrated and thus easier to remove. Some cooling systems use a component known as a variable speed compressor. Contrary to conventional compressors which operate at a singular, set speed, a variable speed compressor may vary its speed depending on the needs of the system. For example, when the cooling demands of a space are great, the variable speed compressor may operate at a high speed. When the cooling needs of a space are low, the variable speed compressor may operate at a low speed. As a result, a variable speed compressor may lower the power consumption of a cooling system compared to a conventional compressor that operates at only a single speed.

Using a variable speed compressor introduces certain issues for a cooling system. When a variable speed compressor operates at a low speed, the rate of flow of the refrigerant in the system drops. As a result, it may become difficult to maintain a consistent refrigerant flow to components in the system, which may cause these components may sputter or operate inefficiently. For example, for an expansion valve (or another expansion device) in the system to operate optimally, the refrigerant entering the valve should be entirely in a liquid state. When the rate of flow of refrigerant in the system drops, the liquid refrigerant entering the valve may become insufficiently low and mix with vapor, thus reducing the efficiency of the valve.

One way to address this issue is to add more refrigerant to the system so that the system can operate efficiently when the variable speed compressor is operating at a low speed. However, this additional refrigerant may prove to be too much when the variable speed compressor switches to operating at a high speed. At high speeds the refrigerant may flow too quickly, and the system may not be able to sufficiently reject and/or dispel the heat in the refrigerant. As a result, the pressure in the system may rise. When the pressure in the system rises, the system may operate inefficiently.

This disclosure contemplates an unconventional cooling system that includes a heat exchanger that can be used to effectively expand the volume of the high pressure side (e.g., a condenser, heat pump, high side heat exchanger) of the cooling system. By varying the volume of the high pressure side, the cooling system can efficiently manage the high side pressure in the system. For example, when the variable speed compressor is operating at a low speed, the refrigerant can be directed away from the heat exchanger to the rest of the system. As a result, the volume of the system is effectively decreased, which increases the system pressure. When the variable speed compressor is operating at a high speed, the refrigerant can be directed through the heat exchanger to the rest of the system. As a result, the volume of the system is effectively increased thereby decreasing the refrigerant pressure in the system and preventing the refrigerant from backing up. Additionally, by using the heat exchanger, the cooling system expands the volume of the high pressure side of the cooling system while increasing the heat exchanger surface through which to cool the refrigerant rather than by merely increasing the storage capacity for the refrigerant (e.g. by adding a storage or holding tank). This disclosure contemplates a compressor operating at a low speed and a high speed. However, this disclosure contemplates that the low speed may be any speed so long as it is lower than the high speed. Likewise, this disclosure contemplates the high speed being any speed so long as it is higher than the low speed.

Certain embodiments provide one or more technical advantages. For example, an embodiment effectively expands the volume of the high pressure side when a variable speed compressor is operating at a high speed by directing refrigerant to an additional heat exchanger. As another example, an embodiment effectively lowers the volume of the high pressure side when a variable speed compressor is operating at a low speed by directing refrigerant away from an additional heat exchanger. As yet another example, an embodiment improves the efficiency of a cooling system when a variable speed compressor switches from operating at a low speed to a high speed. The unconventional cooling system will be described using FIGS. 1 through 3.

FIG. 1 illustrates portions of an example heating or cooling system 100. As shown in FIG. 1, cooling system 100 includes a high side heat exchanger 105, a three-way valve 110, an expansion valve 112, a heat exchanger 115, a load 120, a compressor 125, and a controller 130. In particular embodiments, cooling system 100 may improve the efficiency of the system by directing refrigerant to heat exchanger 115 when compressor 125 is operating at a high speed and by directing refrigerant away from heat exchanger 115 when compressor 125 is operating at a low speed.

High side heat exchanger 105 may remove heat from the refrigerant. When heat is removed from the refrigerant, the refrigerant is cooled. This disclosure contemplates high side heat exchanger 105 being operated as a condenser, a gas cooler, a fluid cooler, and/or a heat pump. When operating as a condenser, high side heat exchanger 105 cools the refrigerant such that the state of the refrigerant changes from a gas to a liquid. When operating as a gas cooler, high side heat exchanger 105 cools the refrigerant but the refrigerant remains a gas. When operating as a fluid cooler, high side heat exchanger 105 cools the refrigerant but the refrigerant remains a fluid and/or liquid. When operating as a heat pump, high side heat exchanger 105 heats the refrigerant and absorbs heat from a warmer surrounding environment. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building.

Three-way valve 110 may receive refrigerant from high side heat exchanger 105 and direct it to one of two locations depending on its mode of operation. Three-way valve 110 may include three ports: a first port to receive refrigerant from high side heat exchanger 105, a second port to direct the refrigerant directly to load 120 through expansion valve 112, and a third port to direct the refrigerant to heat exchanger 115. In some embodiments, the first port remains open and the second and third ports open and close alternately. In other words, when the second port is open, the third port is closed, and vice versa. When the second port is open, refrigerant flows from three-way valve 110 directly to load 120 through expansion valve 112. When the third port is open, refrigerant flows from three-way valve 110 to heat exchanger 115.

In a first mode of operation, the second port may be open and three-way valve 110 may direct refrigerant to load 120 through expansion valve 112. In a second mode of operation, the third port may be open and three-way valve 110 may direct refrigerant to heat exchanger 115. Heat exchanger 115 may then direct the refrigerant to load 120 through expansion valve 112. The mode of operation of three-way valve 110 may be controlled by controller 130. The modes of operation of three-way valve 110 may correspond to the speed of compressor 125. For example, when compressor 125 is operating at a low speed, three-way valve 110 may be in its first mode of operation. When compressor 125 is operating at a high speed, three-way valve 110 may be in its second mode of operation.

Expansion valve 112 reduces the pressure and therefore the temperature of the refrigerant. Expansion valve 112 reduces pressure from the refrigerant flowing into the expansion valve 112. The temperature of the refrigerant may then drop as pressure is reduced. As a result, refrigerant entering expansion valve 112 may be cooler when leaving expansion valve 112. The refrigerant leaving expansion valve 112 is fed to load 120.

Heat exchanger 115 may receive refrigerant from three-way valve 110 and remove heat from the refrigerant. For example, heat exchanger 115 may transfer heat from the refrigerant to another refrigerant or by dispelling that heat to air such as, for example, air in an external environment. Heat exchanger 115 may include any suitable components for transferring this heat such as, for example, thermal conducting fins, plates and/or tubes, and/or fans. After removing heat from the refrigerant, heat exchanger 115 may direct the refrigerant to load 120 through expansion valve 112. In particular embodiments, heat exchanger 115 may improve the efficiency of system 100 by removing additional heat from the refrigerant. Additionally, heat exchanger 115 effectively expands the volume of the high pressure side of cooling system 100 when compressor 125 is operating at a high speed in certain embodiments. By expanding the volume of the high pressure side of system 100, the pressure of the refrigerant in system 100 may be reduced when compressor 125 is operating at a high speed. Reducing this pressure improves the efficiency of system 100 in certain embodiments.

When heat exchanger 115 is not being used, the refrigerant in heat exchanger 115 may be drained to compressor 125 through a drain line that leads to line 123, which feeds into compressor 125. For example, when three-way valve 110 is operating in a first mode of operation and/or when compressor 125 is operating at a low speed, the refrigerant in heat exchanger 115 may be drained to compressor 125 through the drain line and line 123. As a result, the effective volume of the high pressure side of system 100 is reduced but the amount of refrigerant in system 100 is maintained. The draining may occur as a result of the pressure difference between the two ends of the drain line. Heat exchanger 115 is positioned in the high pressure side of system 100, which is typically characterized as the part of system 100 between the discharge of compressor 125 and the inlet of expansion valve 112, and compressor 125 is positioned in the low pressure side of system 100, which is typically characterized as the part of system 100 between the outlet of expansion valve 112 and the suction of compressor 125. Because the side of the drain line at heat exchanger 115 is at a high pressure and the side of the drain line at line 123 is at a low pressure, there is a pressure difference across the drain line that causes the refrigerant to drain from heat exchanger 115 to line 123.

Refrigerant may flow from expansion valve 112 to load 120. When the refrigerant reaches load 120, the refrigerant removes heat from air around load 120. As a result, that air is cooled. The cooled air may then be circulated such as, for example, by a fan, to cool space 122, which may be a room of a building. As refrigerant passes through load 120, the refrigerant may change from a liquid state to a gaseous state.

Refrigerant may flow from load 120 to compressor 125 through line 123. This disclosure contemplates system 100 including any number of compressors 125. Compressor 125 may be configured to increase the pressure of the refrigerant. As a result, the heat in the refrigerant may become concentrated and the refrigerant may become a high pressure gas. Compressor 125 may then send the compressed refrigerant gas to high side heat exchanger 105. Compressor 125 may be a variable speed compressor that operates at various speeds depending on the needs of system 100. For example, when the cooling demands of system 100 are great, compressor 125 may operate at a high speed. When the cooling demands of system 100 are low, compressor 125 may operate at a low speed.

Controller 130 may control the operation of various components of system 100 such as, for example, three-way valve 110 and compressor 125. For example, controller 130 may switch three-way valve 110 between a first mode of operation and a second mode of operation to direct refrigerant to different components of system 100. As another example, controller 130 may vary the speed of compressor 125. As shown in FIG. 1, controller 130 includes a processor 135 and a memory 140. This disclosure contemplates processor 135 and memory 140 being configured to perform any of the functions of controller 130 described herein.

Processor 135 may be any electronic circuitry, including, but not limited to microprocessors, application specific integrated circuits (ASIC), application specific instruction set processor (ASIP), and/or state machines, that communicatively couples to a memory 140 and controls the operation of system 100. The processor 135 may be 8-bit, 16-bit, 32-bit, 64-bit or of any other suitable architecture. The processor 135 may include an arithmetic logic unit (ALU) for performing arithmetic and logic operations, processor registers that supply operands to the ALU and store the results of ALU operations, and a control unit that fetches instructions from memory 140 and executes them by directing the coordinated operations of the ALU, registers and other components. The processor 135 may include other hardware and software that operates to control and process information. The processor 135 executes software stored on memory to perform any of the functions described herein. The processor 135 controls the operation and administration of system 100 by processing information from controller 130, sensor(s), and memory 140. The processor 135 may be a programmable logic device, a microcontroller, a microprocessor, any suitable processing device, or any suitable combination of the preceding. The processor 135 is not limited to a single processing device and may encompass multiple processing devices.

The memory 140 may store, either permanently or temporarily, data, operational software, or other information for the processor 135. The memory 140 may include any one or a combination of volatile or non-volatile local or remote devices suitable for storing information. For example, the memory 140 may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in the memory 140, a disk, a CD, or a flash drive. In particular embodiments, the software may include an application executable by the processor 135 to perform one or more of the functions described herein.

In operation, system 100 may cycle refrigerant through load 120 to absorb heat from space 122 to cool space 122. When the cooling demands of system 100 are not great, controller 130 may instruct three-way valve 110 to operate in a first mode of operation and compressor 125 to operate at a low speed. A port for directing refrigerant to heat exchanger 115 closes and a port for directing refrigerant directly to expansion valve 112 and load 120 opens. As a result, refrigerant flows directly from high side heat exchanger 105 through three-way valve 110 directly to load 120. Any refrigerant in heat exchanger 115 is drained to compressor 125 through the drain line and line 123 as a result of the pressure difference across the drain line, as explained above. As a result, all or substantially all of the refrigerant in the system is directed away from heat exchanger 115. In particular embodiments, this allows compressor 125 to operate at a low speed while maintaining consistent refrigerant flow to the components of system 100 which prevents sputtering and/or inefficient operation.

When the cooling demands of system 100 are great, controller 130 may instruct three-way valve 110 to operate in a second mode of operation and compressor 125 to operate at a high speed. The refrigerant is then directed from high side heat exchanger 105 through three-way valve 110 to heat exchanger 115. The port that directs refrigerant from three-way valve 110 directly to expansion valve 112 and load 120 closes, and the port directing refrigerant from three-way valve 110 to heat exchanger 115 opens. Heat exchanger 115 then removes heat from the refrigerant and directs the refrigerant to expansion valve 112. In this manner, the volume of the high pressure side of system 100 is effectively increased, which reduces the pressure of the refrigerant in system 100. By reducing the pressure of the refrigerant, compressor 125 may operate at a high speed without reducing the efficiency of system 100 in certain embodiments.

In particular embodiments, controller 130 switches the operation of three-way valve 110 when the speed of compressor 125 exceeds a threshold. Controller 130 monitors the speed of compressor 125 to determine whether the speed of compressor 125 exceeds the threshold. If the speed of compressor 125 exceeds the threshold, controller 130 instructs three-way valve 110 to switch from a first mode of operation to a second mode of operation such that all or substantially all of the refrigerant in system 100 is directed through heat exchanger 115. If the speed of compressor 125 is below the threshold, controller 130 instructs three-way valve 110 to operate in a first mode of operation such that all or substantially all of the refrigerant in the system 100 is directed away from heat exchanger 115. The threshold may be derived empirically for each particular system 100. The threshold may be adjusted based on the needs and configuration of system 100.

In particular embodiments, system 100 includes a temperature sensor 145 that detects a temperature of the refrigerant in system 100. When that detected temperature exceeds a threshold, controller 130 instructs three-way valve 110 to operate in a second mode of operation such that all or substantially all of the refrigerant in system 100 is directed through heat exchanger 115. By directing the refrigerant through heat exchanger 115, the temperature of the refrigerant is further reduced because heat exchanger 115 removes additional heat from the refrigerant. When the temperature of the refrigerant falls below the threshold, controller 130 instructs three-way valve 110 to operate in a first mode of operation such that all or substantially all of the refrigerant in system 100 is directed away from heat exchanger 115. The temperature threshold may be derived empirically for each system 100. The temperature threshold may be adjusted based on the needs and configuration of system 100.

In certain embodiments, system 100 includes a pressure sensor 150 that detects a pressure of the refrigerant in system 100. When the detected pressure exceeds a threshold, controller 130 instructs three-way valve 110 to operate in a second mode of operation such that all or substantially all of the refrigerant in system 100 is directed through heat exchanger 115. As a result, the pressure of the refrigerant in system 100 is reduced because heat exchanger 115 removes additional heat from the refrigerant and because the effective volume of the high pressure side of system 100 is expanded. When the pressure of the refrigerant falls below the threshold, controller 130 instructs three-way valve 110 to operate in a first mode of operation such that all or substantially all of the refrigerant in system 100 is directed away from heat exchanger 115. The pressure threshold may be derived empirically for each system 100. The pressure threshold may be adjusted based on the needs and/or configuration of system 100.

In particular embodiments, the speed of compressor 125 may be varied without harming the efficiency of system 100. For example, when compressor 125 is operating at a low speed, system 100 may direct all or substantially all of the refrigerant in system 100 away from heat exchanger 115. As a result, compressor 125 may be able to maintain a consistent and sufficient flow of refrigerant to other components of system 100 which prevents sputtering and inefficient operation. As another example, when compressor 125 is operating at a high speed, system 100 may direct all or substantially all of the refrigerant in system 100 to heat exchanger 115. Heat exchanger 115 may remove heat from the refrigerant and then direct the refrigerant to expansion valve 112. As a result, the volume of the high pressure side of system 100 is effectively increased which reduces the pressure of the refrigerant in system 100. By reducing the pressure, compressor 125 may operate at a high speed without harming the efficiency of system 100. Furthermore, additional heat may be removed from the refrigerant which further improves the efficiency of system 100.

FIG. 2 illustrates portions of an example heating or cooling system 100. As shown in FIG. 2, the configuration of system 100 may be altered slightly to accommodate high side heat exchanger 105 operating as a heat pump. For example, system 100 may include two expansion valves 112A and 112B, both positioned between high side heat exchanger/heat pump 105 and load 120. Expansion valve 112A may be located between high side heat exchanger 105 and three-way valve 110. Expansion valve 112B may be located between three-way valve 110 and load 120. System 100 may also include a reversing valve that is used to switch high side heat exchanger 105 between cooling mode and heating mode. The direction of flow of refrigerant illustrated in FIG. 2 indicates that system 100 is operating in a cooling mode, but it is contemplated that this flow can be reversed through the reversing valve to operate system 100 in a heating mode.

The operation of system 100 may stay consistent with the description of system 100 in FIG. 1. For example, when compressor 125 is operating at a low speed, controller 130 may instruct three-way valve 110 to operate in a first mode of operation. In response, a port in three-way valve 110 directing refrigerant directly to expansion valve 112B opens, and a port in three-way valve 110 directing refrigerant to heat exchanger 115 closes. The drain line from heat exchanger 115 to compressor 125 also opens. As a result, all or substantially all of the refrigerant in system 100 is directed away from heat exchanger 115.

When compressor 125 is operating at a high speed, controller 130 may instruct three-way valve 110 to operate in a second mode of operation. In response, the port in three-way valve 110 directing refrigerant directly to expansion valve 112B closes, and the port in three-way valve 110 directing refrigerant to heat exchanger 115 opens. The drain line may also close. As a result, all or substantially all of the refrigerant in system 100 is routed through heat exchanger 115.

In some embodiments, high side heat exchanger 105 may operate in a cooling mode and a heating mode. In some situations, the amount of refrigerant in system 100 is inappropriate for cooling mode or heating mode. For example, if an indoor heat exchanger is smaller than an outdoor heat exchanger, then there may be too much refrigerant in system 100 for heating mode. If the indoor heat exchanger is larger than the outdoor heat exchanger, then there may be too much refrigerant in system 100 for cooling mode. Heat exchanger 115 may be used to balance the refrigerant between heating mode and cooling mode. For example, heat exchanger 115 may be used to store refrigerant while system 100 is operating in heating mode. As a result, all or substantially all of the refrigerant in system 100 may be directed through heat exchanger 115 in heating mode and all or substantially all of the refrigerant in system 100 may be directed away from heat exchanger 115 during cooling mode. In particular embodiments, use of heat exchanger 115 may improve the efficiency of system 100 when high side heat exchanger 105 switches between cooling and/or heating mode because the heat exchanger 115 stores additional and/or unnecessary refrigerant and/or balances the refrigerant between heating and/or cooling modes.

In certain embodiments, system 100 may include unillustrated components such as for example a reversing valve that operates to alternate system 100 between a heating mode and a cooling mode. In the heating mode, the reversing valve directs refrigerant from compressor 125 to an indoor coil (e.g., load 120) and refrigerant from an outdoor coil (e.g., heat exchanger 115, high side heat exchanger 105) to compressor 125. In the cooling mode, the reversing valve directs refrigerant from compressor 125 to an outdoor coil (e.g., heat exchanger 115, high side heat exchanger 105) and refrigerant from an indoor coil (e.g., load 120) to compressor 125. As a result, the direction of flow of refrigerant in system 100 may be reversed using the reversing valve to switch system 100 between cooling mode and heating mode.

FIG. 3 is a flowchart illustrating a method 300 for operating the systems 100 of FIGS. 1 and 2. In particular embodiments, various components of system 100 may perform method 300. By performing method 300, the efficiency of system 100 may be maintained when the speed of a compressor changes from low speeds to high speeds.

A high side heat exchanger removes heat from a refrigerant in step 305. In step 310, a controller determines whether a valve should operate in a first or a second mode of operation. This determination may be made based on the speed of a compressor in system 100. For example, if the compressor is operating at a low speed, the controller may determine that the valve should operate in a first mode of operation. If the compressor is operating at a high speed, the controller may determine that the valve should operate in a second mode of operation.

If the controller determines that the valve should operate in a second mode of operation, the valve may direct the refrigerant to a heat exchanger in step 315. The heat exchanger may remove heat from the refrigerant in step 320. The heat exchanger may direct the refrigerant to a load and the load may remove heat from a space using the refrigerant in step 325. Then, the compressor compresses the refrigerant in step 330. If the controller determines that the valve should operate in a first mode of operation in step 310, then the valve may direct the refrigerant to the load so the load can remove heat from the space using the refrigerant in step 325. Then the compressor compresses the refrigerant in step 330.

Modifications, additions, or omissions may be made to method 300 depicted in FIG. 3. Method 300 may include more, fewer, or other steps. For example, steps may be performed in parallel or in any suitable order. While discussed as system 100 (or components thereof) performing the steps, any suitable component of system 100 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a high side heat exchanger configured to remove heat from a refrigerant;

a second heat exchanger configured to remove heat from the refrigerant;

a load configured to use the refrigerant to remove heat from a space proximate the load;

a variable speed compressor configured to compress the refrigerant from the load and to direct the compressed refrigerant to the high side heat exchanger;

a three-way valve configured to:

when operating in a first mode, direct the refrigerant from the high side heat exchanger to the load rather than the second heat exchanger such that the load:

uses the refrigerant from the high side heat exchanger to remove heat from the space; and directs the refrigerant away from the second heat exchanger and towards the variable speed compressor; and when operating in a second mode, direct the refrigerant from the high side heat exchanger to the second heat exchanger before the refrigerant reaches the load; and a temperature sensor configured to detect a temperature of the refrigerant, wherein the three-way valve is further configured to switch from operating in the first mode to the second mode in response to the temperature sensor detecting a temperature of the refrigerant that exceeds a threshold.

2. The apparatus of claim 1, wherein the second heat exchanger is further configured to direct the refrigerant in the second heat exchanger through a drain line to the variable speed compressor when the three-way valve is operating in the first mode.

3. The apparatus of claim 2, wherein the three-way valve is further configured to switch from operating in the first mode to the second mode in response to the variable speed compressor operating at a speed that is above a threshold.

4. The apparatus of claim 1, further comprising a pressure sensor configured to detect a pressure of the refrigerant, wherein the three-way valve is further configured to switch from operating in the first mode to the second mode in response to the pressure sensor detecting a pressure of the refrigerant that exceeds a threshold.

5. The apparatus of claim 1, further comprising a first expansion valve and a second expansion valve, both the first and second expansion valves positioned between the high side heat exchanger and the load, the high side heat exchanger is a heat pump, and the three-way valve is positioned between the first expansion valve and the second expansion valve.

6. The apparatus of claim 1, further comprising a controller configured to switch the operation of the three-way valve between the first mode and the second mode.

7. A method comprising:

removing heat from a refrigerant using a high side heat exchanger;

when operating in a first mode:

directing the refrigerant from the high side heat exchanger to a load rather than the second heat exchanger;

using, by the load, the refrigerant from the high side heat exchanger to remove heat from the space; and directing, by the load, the refrigerant away from a second heat exchanger and towards a variable speed compressor;

when operating in a second mode:

directing the refrigerant from the high side heat exchanger to the second heat exchanger before the refrigerant reaches the load;

removing heat from the refrigerant using the second heat exchanger;

directing the refrigerant from the second heat exchanger to the load; and using the refrigerant to remove heat from a space proximate the load;

compressing the refrigerant from the load using the variable speed compressor;

directing the compressed refrigerant to the high side heat exchanger;

detecting a temperature of the refrigerant; and switching from operating in the first mode to the second mode in response to the detected temperature exceeding a threshold.

8. The method of claim 7, further comprising directing the refrigerant in the second heat exchanger through a drain line to the variable speed compressor when operating in the first mode.

9. The method of claim 8, further comprising switching from operating in the first mode to the second mode when the variable speed compressor operates at a speed that is above a threshold.

10. The method of claim 7, further comprising:

detecting a pressure of the refrigerant; and switching from operating in the first mode to the second mode when the detected pressure exceeds a threshold.

11. The method of claim 7, wherein a first expansion valve and a second expansion valve are positioned between the high side heat exchanger and the load, the high side heat exchanger is a heat pump, and a three-way valve is positioned between the first expansion valve and the second expansion valve.

12. The method of claim 7, further comprising switching between the first mode and the second mode using a controller.

13. A system comprising:

a high side heat exchanger configured to remove heat from a refrigerant;

a second heat exchanger configured to remove heat from the refrigerant;

a load configured to use the refrigerant to remove heat from a space proximate the load;

a variable speed compressor configured to compress the refrigerant from the load and to direct the compressed refrigerant to the high side heat exchanger;

a three-way valve configured to:

when operating in a first mode, direct the refrigerant from the high side heat exchanger to the load rather than the second heat exchanger such that the load:

uses the refrigerant from the high side heat exchanger to remove heat from the space; and directs the refrigerant away from the second heat exchanger and towards the variable speed compressor; and when operating in a second mode, direct the refrigerant from the high side heat exchanger to the second heat exchanger before the refrigerant reaches the load;

a controller configured to switch the operation of the three-way valve between the first mode and the second mode; and a temperature sensor configured to detect a temperature of the refrigerant, wherein the three-way valve is further configured to switch from operating in the first mode to the second mode in response to the temperature sensor detecting a temperature of the refrigerant that exceeds a threshold.

14. The system of claim 13, wherein the second heat exchanger is further configured to direct the refrigerant in the second heat exchanger through a drain line to the variable speed compressor when the three-way valve is operating in the first mode.

15. The system of claim 14, wherein the three-way valve is further configured to switch from operating in the first mode to the second mode in response to the variable speed compressor operating at a speed that is above a threshold.

16. The system of claim 13, further comprising a pressure sensor configured to detect a pressure of the refrigerant, wherein the three-way valve is further configured to switch from operating in the first mode to the second mode in response to the pressure sensor detecting a pressure of the refrigerant that when the detected pressure exceeds a threshold.

17. The system of claim 13, further comprising a first expansion valve and a second expansion valve, both the first and second expansion valves positioned between the high side heat exchanger and the load, the high side heat exchanger is a heat pump, and the three-way valve is positioned between the first expansion valve and the second expansion valve.

* * * * *